United States Patent [19]

Greiner et al.

[11] 4,426,988

[45] Jan. 24, 1984

[54] CONTROL ELEMENT

[75] Inventors: Max Greiner, Gerlingen; Gerold Grimm; Heinrich Knapp, both of Leonberg, all of Fed. Rep. of Germany

[73] Assignee: Robert Bosch GmbH, Stuttgart, Fed. Rep. of Germany

[21] Appl. No.: 411,229

[22] Filed: Aug. 25, 1982

[30] Foreign Application Priority Data

Jan. 5, 1982 [DE] Fed. Rep. of Germany ..... 3200096

[51] Int. Cl.[3] ..... F02M 23/04

[52] U.S. Cl. ..... 123/585

[58] Field of Search ..... 123/585–589, 123/339; 251/309, 313, 337

[56] References Cited

U.S. PATENT DOCUMENTS

| | | | |
|---|---|---|---|
| 2,886,020 | 5/1959 | Wolfe | 123/327 |
| 2,943,615 | 7/1960 | Kainz | 123/339 |
| 4,216,938 | 8/1980 | Inada et al. | 123/339 |
| 4,294,217 | 10/1981 | Glöcklen | 123/588 |
| 4,369,755 | 1/1983 | Saito | 123/558 |

*Primary Examiner*—William A. Cuchlinski, Jr.
*Attorney, Agent, or Firm*—Edwin E. Greigg

[57] ABSTRACT

A control device with an electric servo motor is proposed, by means of which a throttle device can be operated, which opens, to a greater or lesser degree, the passage diameter of a flow line, especially the passage diameter of a by-pass line around a throttle valve disposed in the intake line of an internal combustion engine. The control device has an elastic element which moves the throttle device, during an interruption of the current supply to the electric servo motor into a defined position opening the passage diameter of the flow line.

4 Claims, 1 Drawing Figure

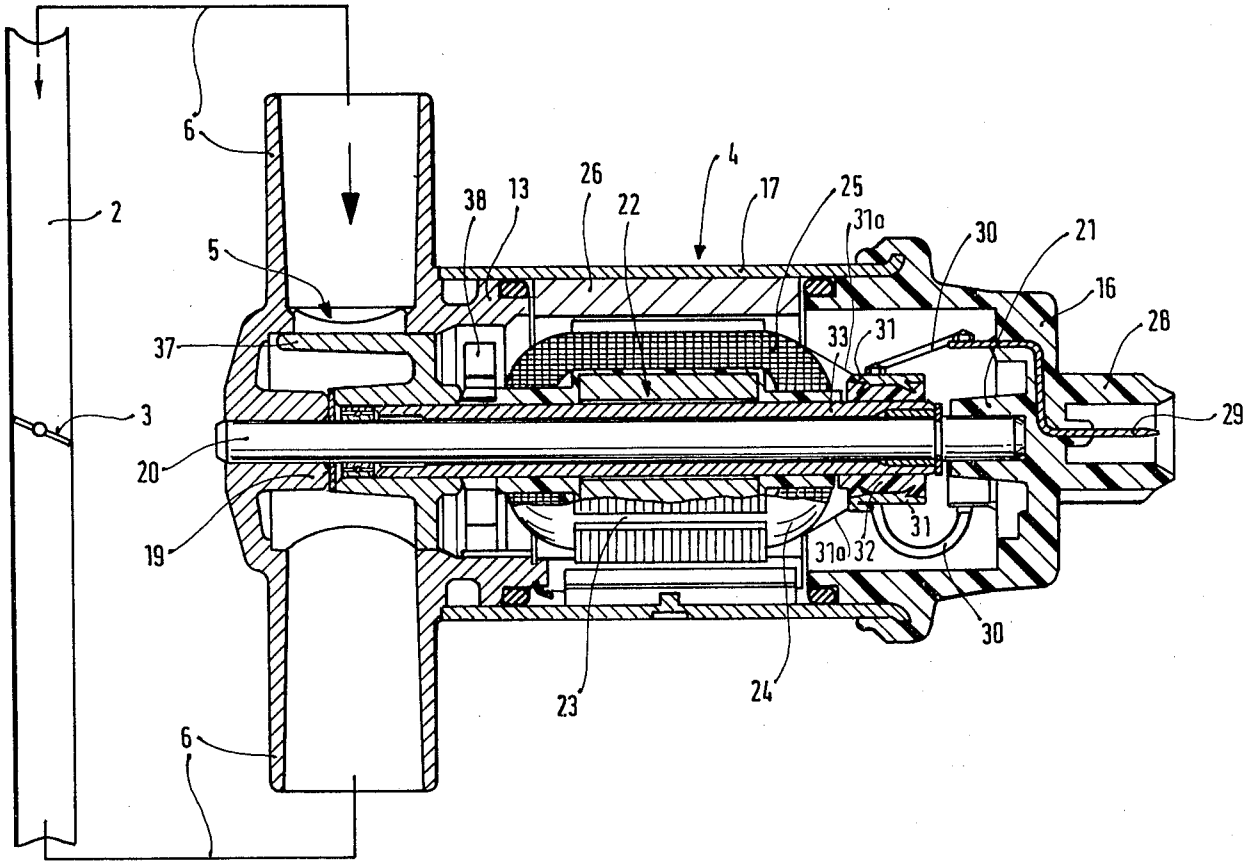
29
28
16
21
30
30
31
31
32
31a
31a
33
25
24
17
4
22
26
23
13
38
5
6
6
37
20
19
3
2

CONTROL ELEMENT

BACKGROUND OF THE INVENTION

The present invention relates to a control device with an electric servo motor, by means of which a throttle device can be arranged to open to a greater or lesser degree, the passage diameter of a flow line, especially the passage diameter of a by-pass line around a throttle valve disposed in the intake line of an internal combustion engine. Such control elements are already known (German Offenlegungsschrift Nos. 28 12 292, 30 01 473, 30 19 167), which, however, have the disadvantage that in case of a loss of the current supply of the servo motor or, during their use in a motor vehicle, when the internal combustion engine is turned off, the throttle device controlling the diameter of the flow line remains in that opening position into which it was placed by the servo motor at that time, or is moved to a fully closed or fully open position, which can cause problems during starting or further running of the internal combustion engine.

OBJECT AND SUMMARY OF THE INVENTION

In contrast to the foregoing, the control element in accordance with the present invention and described hereinafter has the advantage that during an interruption of the current supply of the electric servo motor the throttle device can be moved into a predetermined position which opens a set passage diameter of the flow line advantageous for the continued running of the device or of the internal combustion engine and insuring a starting of the internal combustion engine as trouble-free as possible.

Advantageous further developments and improvements of the control device are revealed in the specification. It is especially advantageous to move the throttle device into a position where the passage diameter of the flow line is opened approximately one quarter to one half, when the current supply of the servo motor has been interrupted.

The invention will be better understood and further objects and advantages thereof will become more apparent from the ensuing detailed description of a preferred embodiment taken in conjunction with the drawings.

BRIEF DESCRIPTION OF THE DRAWINGS

An exemplary embodiment of the present invention is shown in simplified form in the drawings and is further explained in the following description.

DESCRIPTION OF A PREFERRED EMBODIMENT

A control device 4 is shown in section in the drawings, such as is known, for instance from German Offenlegungsschrift 30 01 473. The control device 4 is operated by an electronic control device (not shown), which is fed, for instance, a signal collected from a distributor of an internal combustion engine relating to the rpm, a signal relating to the temperature and the value of a voltage indicating the position of a throttle valve 3 in the intake line 2 of the internal combustion engine. By means of the control element 3 a throttle device 5 is rotated, which is cylindrically formed and opens, to a greater or lesser degree, the passage diameter of a flow line 6, for instance the passage diameter of a by-pass line of a throttle valve 3 in the intake line 2 of an internal combustion engine for the purpose of regulating the rpm during idling. The control device 4 is equipped with a cover 13 limiting the control device on the one side axially and formed as a casting with a part of the flow line 6. The side of the control device 4 away from the cover 13 is limited by a fitting insulating cover 16. A tubular housing 17 forms the connection between the cover 13 and the insulated cover 16. In a protrusion 19 of the flow line 6 an axle or shaft 20 is imbedded, which shaft is fixed on its other end in a protrusion 21 of the cover 16. An aramature 22 of the servo motor of the control device is fixed pivotably on the axle 20. Two coils 24, 25, shifted 90° from each other and operating in opposite directions, are provided in grooves 23 of the armature 22 for the purpose of creating as reversible rotational movement. The two coils 24, 25 are operated in a known manner (German Offenlegungsschrift No. 28 12 292) by the electronic control device through dc-impulses of variable, interrelated duty factors, so that the armature 22 assumes a position related to the duty factors in the magnetic field formed by two segmental permanent magnets 26. The electrical connection of the control device 4 is made by means of a socket or neck portion 28 arranged to receive three plug connectors 29. The plug connectors 29 are connected by flexible wires 30 with contact elements 31, which are disposed on an insulating body 32 coupled with a bearing sleeve 33 in a rotationally fixed manner. The bearing sleeve 33 is fixed pivotably on the shaft or axle 20 and rotationally fixed with the throttle device 4 and the armature 22. The contact elements 31 are connected on their other ends with the coil ends 31*a* of the coils 24, 25. Because of the clocked operation of the control device, frictional resistance is reduced.

The throttle device 5, formed as a rotary slide penetrates, with little play, the cover 13 and the flow line 6 with a control section 37. The control section 37 opens to a greater or lesser degree and dependent on the position of the rotary slide 5 the passage diameter of the flow line 6.

Furthermore, a coil spring 38, serving as an elastic element, is connected with the bearing sleeve 33 and is fastened with its end portion to the housing, for instance to the cover 13. The coil spring 38 is designed to rotate with bearing sleeve 33 and with it the throttle device 5 into a predetermined position in case of an interruption of the electrical supply of the electric servo motor 22, 26, in which the control section 37 of the throttle device 5 opens a clearly defined passage diameter of the flow line 6. An interruption of the current supply can be caused, when the control device is used in a motor vehicle, for instance because of the stopping of the internal combustion engine or a technical defect. The rotation of the throttle device 5 by the coil spring 38 into a pre-determined position for the opening of a defined passage diameter of the flow line 6 has the advantage that, when starting the internal combustion engine, a pre-determined advantageous amount of air can flow to the engine through the flow line 6 at the throttle valve 3; and that during an interruption of the current flow to the servo motor because of a technical defect an advantageous fuel-air mixture can be provided for the continued running of the internal combustion engine. It is especially advantageous when, during an interruption of the current flow to the servo motor, the throttle device 5 can be rotated to a position in which it opens a defined passage diameter of the flow line 6, lying in about the area between a quarter and a half of the passage diameter.

According to the present invention it will be possible, in a corresponding way to supply a solenoid control device, as known, for instance, from German Offenlegungsschrift No. 30 90 167, with an elastic element acting on a throttle element in such a way that, during an interruption of the supply of electricity to the electric servo motor, the throttle element moves into a defined position which opens the passage diameter of the flow line.

The foregoing relates to a preferred exemplary embodiment of the present invention, it being understood that other embodiments and variants thereof are possible within the spirit and scope of the invention, the latter being defined by the appended claims.

What is claimed and desired to be secured by Letters Patent of the United States is:

1. A control device including an electric servo motor controlled by a current supply, said control device further including a throttle device which opens, to a greater or lesser degree a passage diameter of a by-pass flow line around a throttle valve disposed in an intake line of an internal combustion engine, wherein said control device has at least one elastic element secured thereto by means of which, during an interruption of said current supply of said electric servo motor, said throttle device can be moved by said at least one elastic element into a defined position thereby opening said passage diameter of said flow line.

2. A control device in accordance with claim 1, characterized in that said throttle device is pivotably arranged in said flow line and in that a coil spring serves as said elastic element.

3. A control device in accordance with claim 2, characterized in that said throttle device, during an interruption of said current supply of said electric servo motor can be moved by said elastic element into a position in which said passage diameter of said flow line is opened to about a quarter to a half.

4. A control device in accordance with claim 1, characterized in that said throttle device, during an interruption of said current supply of said electric servo motor can be moved by said elastic element into a position in which said passage diameter of said flow line is opened to about a quarter to a half.

* * * * *